US010790102B2

(12) United States Patent
Doenoglu et al.

(10) Patent No.: US 10,790,102 B2
(45) Date of Patent: Sep. 29, 2020

(54) HOLDING ADAPTER FOR FIXING CONTROL AND SIGNALING DEVICES AND ALSO ARRANGEMENT

(71) Applicant: EATON INTELLIGENT POWER LIMITED, Dublin (IE)

(72) Inventors: Luetfiye Doenoglu, Bonn (DE); Joerg Schaefer, Rheinbach (DE); Deepak Sanan, Bonn (DE); Artur Wiese, Bornheim (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/329,768

(22) PCT Filed: Sep. 5, 2017

(86) PCT No.: PCT/EP2017/072146
§ 371 (c)(1),
(2) Date: Mar. 1, 2019

(87) PCT Pub. No.: WO2018/042045
PCT Pub. Date: Mar. 8, 2018

(65) Prior Publication Data

US 2019/0198268 A1 Jun. 27, 2019

(30) Foreign Application Priority Data

Sep. 5, 2016 (DE) ..... 10 2016 116 518

(51) Int. Cl.
*H01H 13/04* (2006.01)
*H01H 3/54* (2006.01)
*H01H 13/10* (2006.01)

(52) U.S. Cl.
CPC ..... *H01H 13/04* (2013.01); *H01H 3/54* (2013.01); *H01H 13/10* (2013.01)

(58) Field of Classification Search
CPC ..... H01H 13/04; H01H 3/54; H01H 13/10
(Continued)

(56) References Cited

U.S. PATENT DOCUMENTS 6,770,829 B1 * 8/2004 Hart ..... H01H 1/5805 200/292
9,589,741 B2 3/2017 Wiese et al.
2016/0196933 A1 * 7/2016 Wiese ..... H01H 3/022 200/341

FOREIGN PATENT DOCUMENTS

DE 1996975 U 11/1968
DE 1665359 * 3/1971 ..... H01H 1/18
(Continued)

*Primary Examiner* — Nguyen Tran
*Assistant Examiner* — Iman Malakooti
(74) *Attorney, Agent, or Firm* — Leydig, Voit & Mayer, Ltd.

(57) ABSTRACT

A holding adapter for fixing control and signaling devices, including pushbuttons, on a front plate, includes: a housing having a first recess; and a mounting plate mounted in the housing and having a second recess. The second recess is arranged flush with the first recess so that a control or signaling device is guidable in an axial direction through the two recesses. The mounting plate is displaceable in the axial direction relative to the housing between a first end position and a second end position so as to provide a vertical compensation when the control or signaling device is fixed to the front plate, depending upon a thickness of the front plate.

10 Claims, 3 Drawing Sheets

(58) Field of Classification Search
USPC ..... 200/341, 345, 520
See application file for complete search history.

(56) References Cited

FOREIGN PATENT DOCUMENTS

| | | | |
|---|---|---|---|
| DE | 19832423 | A1 | 12/1999 |
| DE | 10012264 | A1 | 10/2000 |
| DE | 19757698 | B4 | 6/2006 |
| DE | 602004001497 | T2 | 2/2007 |
| DE | 102010041041 | A1 | 3/2012 |
| WO | WO 2014202654 | A1 | 12/2014 |

* cited by examiner

HOLDING ADAPTER FOR FIXING CONTROL AND SIGNALING DEVICES AND ALSO ARRANGEMENT

CROSS-REFERENCE TO PRIOR APPLICATIONS

This application is a U.S. National Phase application under 35 U.S.C. § 371 of International Application No. PCT/EP2017/072146, filed on Sep. 5, 2017, and claims benefit to German Patent Application No. DE 10 2016 116 518.2, filed on Sep. 5, 2016. The International Application was published in German on Mar. 8, 2018 as WO 2018/042045 under PCT Article 21(2).

FIELD

The invention relates to a holding adapter for fixing control and signaling devices—in particular, pushbuttons—on a front plate. The invention further relates to an arrangement having a control or signaling device and such a holding adapter.

BACKGROUND

Installation systems for buildings or facilities, which often have control or signaling devices, are known from the prior art. Such control or signaling devices have, for example, switches or buttons such as pushbuttons that optionally have a display function. The control or signaling devices are typically mounted in circuit boards, control panels, control cabinet doors, or housing covers. Holding adapters are typically used to fix the control or signaling devices on a front plate, such as a panel or a wall.

Typically, such control or signaling devices are designed to be modular; they consist, for example, of an actuator and a fastening part with a thread. For assembly, the control or signaling device is generally guided from a front side through a hole in the front plate and is mounted from the rear side by means of a fastening element, such as a ring nut. The control or signaling devices can be actuated, and act on a controller. The control or signaling device is typically electrically connected to the controller via terminals.

SUMMARY

In an embodiment, the present invention provides a holding adapter for fixing control and signaling devices, including pushbuttons, on a front plate, the holding adapter comprising: a housing having a first recess; and a mounting plate mounted in the housing and having a second recess, wherein the second recess is arranged flush with the first recess so that a control or signaling device is guidable in an axial direction through the two recesses, and wherein the mounting plate is displaceable in the axial direction relative to the housing between a first end position and a second end position so as to provide a vertical compensation when the control or signaling device is fixed to the front plate, depending upon a thickness of the front plate.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
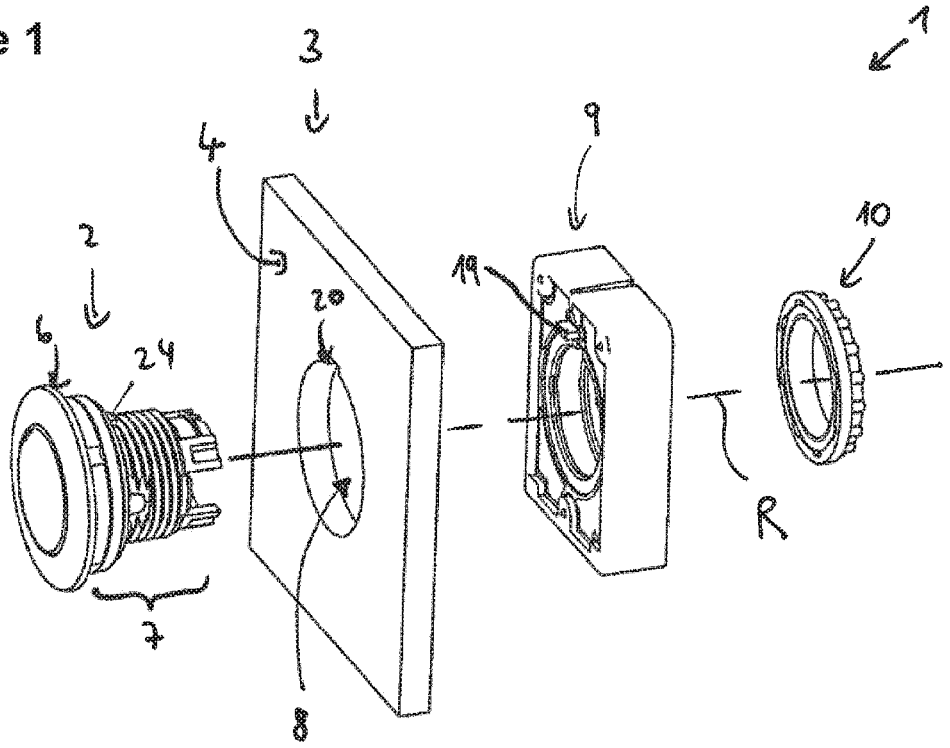
FIGS. 1 and 2 show two perspectival, schematic views of an arrangement with a control device and a holding adapter according to an exemplary embodiment of the invention.

In an embodiment, the present invention provides a concept for a holding adapter that promotes flexible assembly of control and signaling devices.

According to one aspect, a holding adapter is disclosed for fixing control and signaling devices—in particular, pushbuttons—on a front plate. The holding adapter has a housing with a first recess and a mounting plate, mounted in the housing, with a second recess. The second recess is arranged flush with the first recess so that a control or signaling device can be guided in an axial direction through the two recesses. Furthermore, the mounting plate can be displaced in the axial direction relative to the housing between a first end position and a second end position so that, when a control or signaling device is fixed to the front plate, a vertical compensation can be achieved depending upon a thickness of the front plate.

The holding adapter can also be called a fastening device or adapter device. A control or signaling device is fastened to the front plate via the holding adapter. The front plate is typically sheet metal or a wall of a control cabinet or the like.

The mounting plate is configured to interact mechanically with the control or signaling device during fixation. For example, the control or signaling device is guided through the front plate and through the holding adapter, i.e., the mounting plate and the housing. The apparatus is then fixed by means of a fastening element against the holding adapter, e.g., against the housing, and thus against the front plate. In this case, the control or signaling device with a main body interacts with the mounting plate. For example, the main body abuts against the mounting plate. The latter is mounted mechanically in the housing, so that the holding force applied by the fastening element is transmitted to the front plate via the housing.

When fixing—for instance, screwing—the device to the front plate, the mounting plate is displaced relative to the housing, depending upon a thickness of the front plate. Rapid fixing of the holding adapter to the front plate and a variable bearing point are thereby realized. By means of this flexibility, it is possible to compensate for a thickness of the front plate. Typical front plate thicknesses lie in the range of 1 to 6 mm. The holding adapter thus allows a lifting compensation for different thicknesses of the front plate.

A further advantage is that the holding adapter can be tightened with only a few revolutions of a fixing or fastening means, such as a ring nut. Painstaking compensation of the front plate thickness by lengthy turning of the fixing means is thus no longer necessary. Another advantage is that different control or signaling devices can be taken into account by using different mounting plates. It is not necessary to provide different holding adapters—in particular, different housings—for different control or signaling devices. It is sufficient, for example, to adapt the mounting plate accordingly.

The mounting plate is, for example, mounted by means of a latching mechanism in the housing, i.e., displaceably captive in the housing. For example, the mounting plate is guided between two stops in the housing. The mounting plate can, moreover, be displaceably guided using guide elements such as ribs or the like.

According to one embodiment, the housing has a latching mechanism which interacts with the mounting plate for vertical compensation. Such a latching mechanism is, for example, a ratchet mechanism. The mounting plate thus latches in a corresponding position relative to the housing. The displacing and latching of the mounting plate can be prior to fixation on the front plate, but also during fixation, such as fastening by means of the fastening element. In other words, e.g., when tightening and bolting the signaling or control device on the front plate, the mounting plate is latched into a corresponding position.

According to another embodiment, a spring element is mounted in the housing and interacts with the mounting plate so that the mounting plate can be displaced from the first end position counter to a spring force of the spring element in the axial direction relative to the housing. In other words, the spring element is so arranged in the housing and mounted that it exerts a force on the mounting plate that acts in the direction of the first end position. If no additional force acts on the mounting plate, such as through interaction with the control device, the mounting plate is pressed into the first end position. In this unmounted or original state, the mounting plate is thus held in the first position on the housing by means of the spring element. The mounting plate may also be termed a spring plate.

According to another embodiment, the spring element is designed as a compression spring.

Optionally, two or more spring elements can also be mounted in the housing. A uniform force distribution, for example, can thereby be realized.

According to another embodiment, the housing has an anti-twist lug for a keyed interaction with the front plate, which is selectively removable. In other words, the anti-twist lug can be removed such that it no longer interacts with a corresponding recess in the front plate. Typically, the anti-twist lug serves to keep the holding adapter from rotating relative to the front plate when the control or signaling device is in a mounted or fixed state. The anti-twist lug engages in a keyed fit in a corresponding recess in the front plate, so that at least one movement of the holding adapter in a plane parallel to the front plate is blocked in a mounted state. Since the anti-twist lug is optionally designed to be removable, a customer can access the anti-twist lug, or dispense with keyed anti-twist protection, depending upon the design of the front plate.

The anti-twist lug may, for example, be a metallic lug or a lug made of plastic—for example, by means of injection molding. The anti-twist lug is, for example, integrally formed with the housing, or arranged and fastened as a separate element thereon.

According to one embodiment, the anti-twist lug is designed so that it can be broken off or elastically bent against a spring force. In the case of the breakable version, a predetermined breaking point or the like is provided, for example. This makes it possible to manually break off the anti-twist lug. Alternatively, the anti-twist lug can also be designed to be broken off by means of a tool. In the case of the bendable version, the anti-twist lug can, for example, be folded or retracted or bent back. For example, a spring element may be provided that interacts with the anti-twist lug. Alternatively, the anti-twist lug is designed to be elastic or is arranged elastically on the housing. Such an anti-twist lug contributes to the fact that, depending upon the design of a front plate, the keyed anti-twist device can be accessed or dispensed with, without an extra holding adapter or housing being necessary for this purpose.

According to one embodiment, the anti-twist lug is formed as a separate part from the housing, and is latched in a corresponding recess in the housing. For example, the recess is inserted into the corresponding recess in the housing in a form-fit manner, and latched therein.

It should be mentioned at this point that the removable anti-twist lug can also be provided independently of the above-described embodiments of the holding adapter. For example, the anti-twist lug can also be provided for holding adapters that do not allow a vertical compensation of a front plate.

According to a further embodiment, the housing has at least one holding pin which is designed to at least interact in a friction lock with the front plate. The holding pin is understood to mean an element which has a tip, or a shape that tapers to a tip. When a control or signaling device is in a fixed state, a holding force acts, via the housing and the holding pin, on the front plate.

For example, the holding pin drills into the front plate. In other words, when securing the control or signaling device, a force is transmitted by the holding pin to the front plate that ensures that the holding adapter is simultaneously secured to the front plate in a friction lock and/or a keyed fit. An anti-twist device is thereby realized as above.

In one embodiment, the holding pin is produced from a metal material or as an injection-molded part.

According to a further embodiment, the holding pin is a screw, designed as a turning part or formed by bending a metal sheet. For example, edges of a metal sheet are bent to form the holding pin.

According to a further embodiment, two or more holding pins may also be provided. This contributes to a more even force distribution when fixing the control or signaling device.

According to another embodiment, a material hardness of the holding pin is greater than a material hardness of the front plate. This contributes to the friction lock. In particular, it is ensured that the anti-twist protection is ensured when a corresponding holding force is applied.

According to a second aspect, an arrangement is disclosed that has a control or signaling device, a front plate with an opening, and a holding adapter according to one of the above-described embodiments. The arrangement may also be termed an installation system or installation unit. The control or signaling device is guided from a front side of the front plate through the opening in the front plate and fastened by the holding adapter to a rear side of the front plate. The control or signaling device interacts with the displaceable mounting plate of the holding adapter so as to produce a vertical compensation, depending upon a thickness of the front plate.

The arrangement essentially makes possible the aforementioned advantages and functions. For example, the control or signaling device is guided through the opening of the front plate and through the holding adapter, i.e., through the mounting plate and the opening in the housing, wherein a fastening means such as an annular nut is then screwed onto a main body of the control or signaling device, which fastening means exerts a force on the holding adapter and screws it against the front plate from the back. The main body of the control or signaling device has a further stop which, in the mounted state or during mounting, abuts against the mounting plate in such a way that it is displaced relative to the housing of the holding adapter according to the thickness of the front plate. Accordingly, regardless of a thickness of the front plate, the control or signaling device can be easily mounted, without different holding adapters being necessary for varied thicknesses.

According to a further embodiment, the rear side of the front plate has a coating made of an elastic and/or foamed material in a region in which the front plate interacts with a holding pin of the housing at least frictionally. Friction or adhesion is thereby increased if the holding adapter is frictionally fixed to the housing via the holding pin. This can, alternatively, also be achieved by providing the front plate in said region and/or the housing with a material or a coating with increased surface roughness for frictional interaction. The roughness is increased in comparison with the front plate itself or the housing. For example, an abrasive paper is applied to the front plate and/or to the housing.

Figure 2:
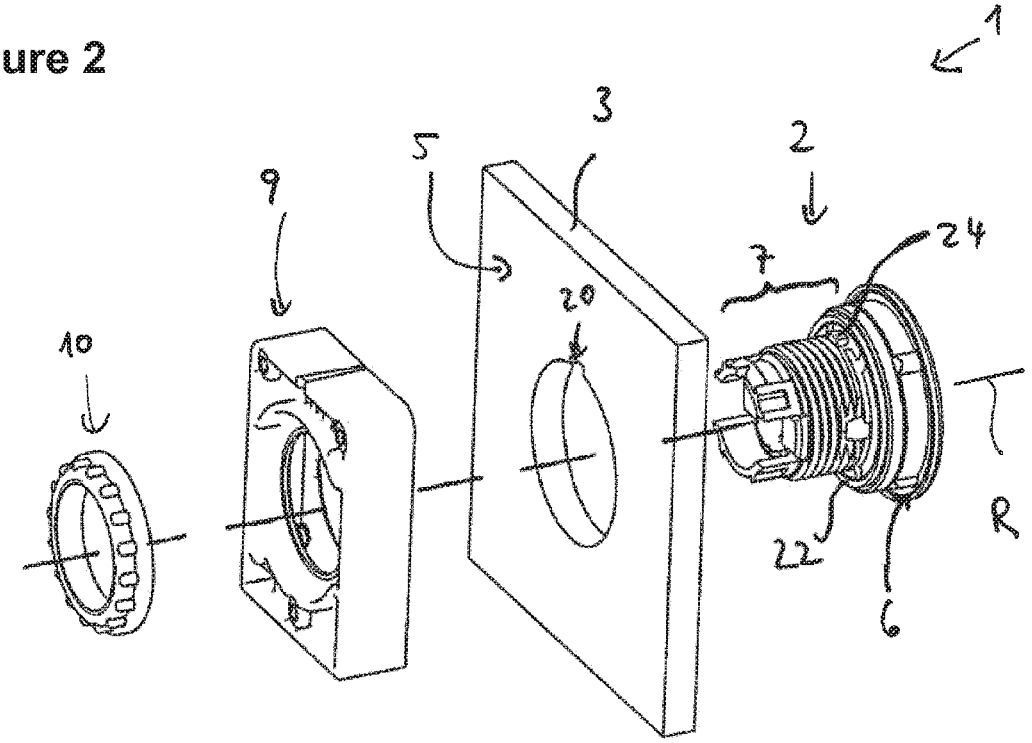

FIGS. 1 and 2 show, in an exploded view, an arrangement 1 for fixing a control device 2 to a front plate 3. FIG. 1 shows a front view with a view of a front side 4 of the front plate 3, whereas FIG. 2 shows a rear view with a view of a rear side 5 of the front plate 3.

The front plate 3 is a wall of a housing, such as of a switchgear cabinet. Alternatively, it can also be a different wall, such as of a building or a plant.

The control device 2, which, in the exemplary embodiment, is a pushbutton, has a rosette 6 and a cylindrical main body 7 adjoining thereon. As shown in the exemplary embodiment, the main body 7 can also be functionally and/or mechanically subdivided.

In particular, the main body 7 has an external threaded section for a screwed fastening to the front plate 3.

In order to fasten the control device 2 to the front plate 3, the control device 2 is guided into a holding adapter 9 along an axial direction R via a corresponding opening 8, which is adapted to the control device 2 in terms of shape, in the front plate 3. The holding adapter 9 is likewise suitably adapted in terms of shape to the control device 2, e.g., to the main body 2, and is configured to receive the control device 2 and fix it securely to the front plate. The holding adapter 9 further has the function that other control or signaling devices can also be fixed on the front plate, irrespective of the configuration of the front plate 3 itself.

Specifically, the control device 2 is screwed from the rear side by a fastening element 10—in the exemplary embodiment, a ring nut or a threaded ring—against the holding adapter 9 and against the front plate 3 thereabove. As a result, the control device 2 (see FIGS. 5 and 6) is securely fastened to the front plate 3. By means of the holding adapter 9 and the fastening element 10, it is possible to also secure the control device 2 with a predefined torque. The holding adapter 9 particularly contributes to a flexible attachment of control devices to a front plate, as will be described in more detail below.

Figure 3:
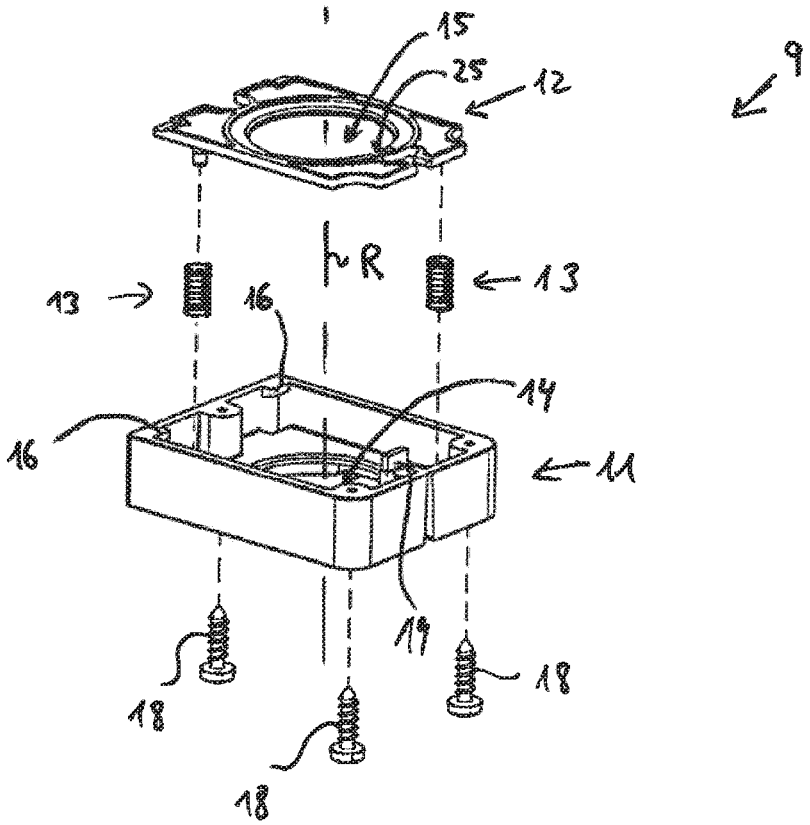
FIG. 3 shows a perspectival exploded view of the holding adapter.

FIG. 3 shows an exploded view of the holding adapter 9 in detail. The holding adapter 9 has a housing 11 in which a mounting plate 12 is mounted displaceably and spring-loaded by two spring elements 13. The mounting plate 12 can also be termed a spring plate. For this purpose, the housing 11 is opened on one side so that the mounting plate 12 can be introduced into the housing 11. The mounting plate 12 is guided within the housing 11 in a keyed manner so that it is displaceable or movable along the axial direction R. Various design options are appropriate for the keyed guidance, such as guide ribs, guide pins, and/or a corresponding coordination of the exterior shape (contour) of the mounting plate 12 to an inner shape of the housing 11. The housing 11 has a first recess 14, and the mounting plate 12 has a second recess 15, which are arranged flush with each other in a mounted state so that the control device 2 can be guided by the two recesses 14, 15 for mounting (see FIGS. 5 and 6).

The housing 11 further has one or more stop elements 16 that prevent the mounting plate 12 from falling out of the housing 11. In addition, the stop elements 16 help enable the mounting plate 12 to be clicked into the housing 11 like a snap-on or latching connection. The mounting plate 12 is spring-loaded by means of the spring elements 13 so that they are pressed along the axial direction against the stop elements 16.

Figure 4:
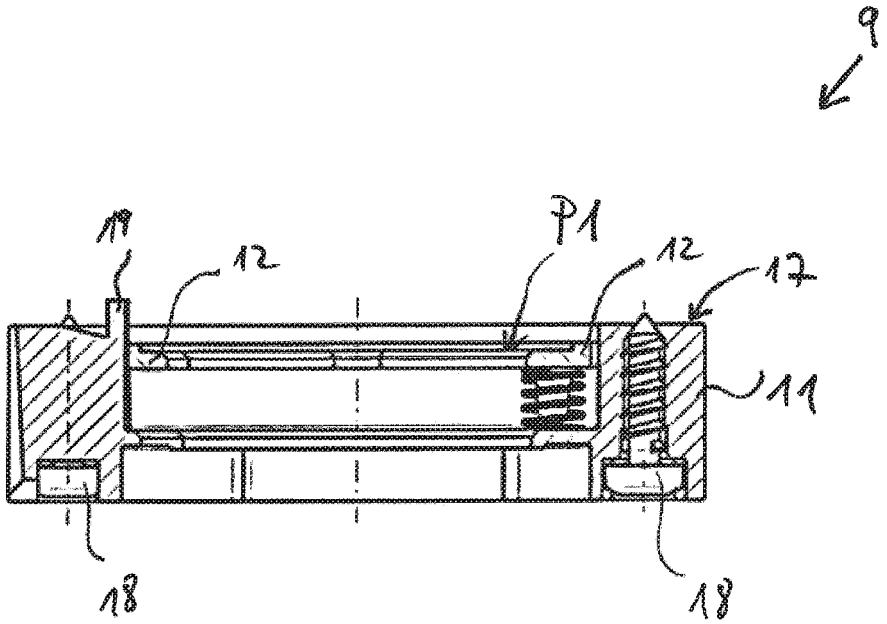
FIG. 4 shows a schematic sectional view of the assembled holding adapter.

FIG. 4 shows a sectional view of the assembled holding adapter 9, wherein the mounting plate 12 is shown in a first end position P1 in the housing 11. The first end position P1 describes the original, relaxed state of the mounting plate 12 with respect to the housing 11, in which it has the smallest distance from a mounting side 17 of the housing 11. The mounting side 17 is assigned to the rear side 5 of the front plate 3. In other words, the mounting side 17 is opposite the front plate 3 when the control device 2 is in a mounted state. The first end position P1 defines a flat position of the mounting plate 12 parallel to the mounting side with respect to the axial direction R. The mounting plate 12 is displaceable against a spring force of the spring elements 13 along the axial direction R within the housing 11 up to a second end position, as will be described later.

FIGS. 3 and 4 also reveal that, in the housing 11, three holding pins 18 are arranged that are designed as screws. The holding pins 18 are screwed into the housing 11 such that at least a small part of a tip of the holding pin 18 protrudes on the mounting side 17. The holding pins 18 can also be designed differently, e.g., as mentioned at the outset, and/or arranged on the housing 11.

Also shown in FIGS. 3 and 4 is an anti-twist lug 19 that is designed integrally with the housing 11 (see also FIG. 1). The anti-twist lug 19 is designed as a protrusion, in order to engage in a keyed manner in a corresponding recess 20 in the front plate 3 when the front plate 3 is in a fixed state (see FIGS. 1 and 2).

Figure 5:
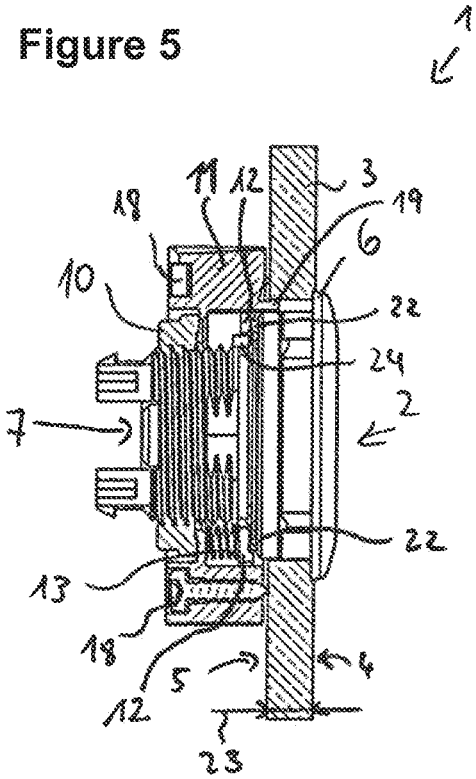
FIG. 5 shows a sectional view of the arrangement in a mounted state.

FIG. 5 shows the arrangement 1 in an assembled state in a schematic, cross-sectional view. In this case, the control device 2 is fixed on the front plate 3 and screwed from an opposite side against the front plate 3. In this case, the fastening element 10 is screwed by the threaded section of the main body 7 to the control device 2, wherein the fastening element 10 contacts the holding adapter 9, i.e., the housing 11. In the exemplary embodiment, the housing 11 has one or more housing stops 21 for the keyed stops of the fastening element 10. By screwing, the front plate 3 is clamped between the holding adapter 9 and the control device 2—in particular, the rosette 6—and thus fastened to the front plate 3.

The main body 7 of the control device 2 further has a stop element 22, which is formed as a ring. In the assembled state, or even during assembly, the stop element 22 contacts the mounting plate 12. Depending upon a thickness 23 of the front plate 3, the mounting plate 12 is now, during tightening, displaced more or less relative to the housing 11 or against the spring force of the spring elements 13. This makes it possible to achieve vertical or lift compensation by means of the holding adapter 9, irrespective of the thickness 23 of the front plate 3.

Figure 6:
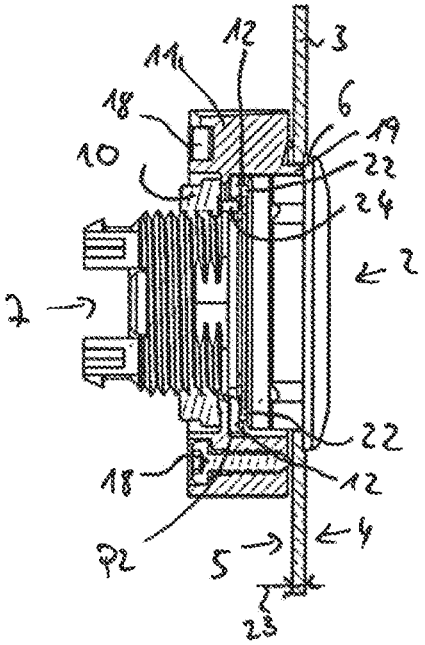
FIG. 6 shows a sectional view of an arrangement in a mounted state according to another embodiment.

In this regard, FIG. 5 shows a thicker front plate 3 in comparison with FIG. 6, wherein it can be seen that the mounting plate 12 is pressed against the housing 11 counter to the spring force of the spring elements 13. In this regard, the mounting plate 12 is located in a second end position P2, which defines a maximum impression of the mounting plate 12 in the axial direction R. It should be pointed out that no spring element 13 can be seen in FIG. 6.

FIGS. 5 and 6 also reveal that the holding adapter 9 is screwed against the front plate 3 such that the holding pins 18 interact with the rear side 5 of the front plate 3. In addition, a frictional and keyed fit of the holding adapter 9 with the front plate 3 is thereby achieved.

Optionally, a material of the holding pins 18 may be harder than a material of the front plate.

Optionally, in the region in which the holding pins 18 interact with the front plate 3 and are in an operative connection, the rear side 5 of the front plate 3 can be coated with a coating, such as an elastic or foamed material—in particular, plastic material.

In the described exemplary embodiments, the anti-twist lug 19 is designed to be removable. For example, the anti-twist lug 19 or the housing 11 has a predetermined breaking point so that it can be broken off if required. As a result, the holding adapter 9 can also be used with front plates which do not have a corresponding recess 20. Alternatively, the anti-twist lug 19 can also be spring-loaded or elastically bendable.

It should further be noted that the main body 7 of the control device 2 also has a further, optional anti-twist lug 24 (see FIGS. 1, 2, 5, and 6) that, as above, interacts with a further recess 25 (see FIG. 3) of the mounting plate 12 in order to realize anti-twist protection.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMBERS

1 Arrangement
2 Control device
3 Front plate
4 Front side
5 Rear side
6 Rosette
7 Main body
8 Opening
9 Holding adapter
10 Fastening element
11 Housing
12 Mounting plate
13 Spring element
14 First recess
15 Second recess
16 Stop element
17 Mounting side
18 Holding pin
19 Anti-twist lug
20 Recess
21 Housing stop
22 Stop element
23 Thickness
24 Anti-twist lug
25 Further recess
P1 First end position
P2 Second end position
R Axial direction

The invention claimed is:

1. A holding adapter for fixing control and signaling devices, including pushbuttons, on a front plate, the holding adapter comprising:

a housing having a first recess; and a mounting plate mounted in the housing and having a second recess, wherein the second recess is arranged flush with the first recess so that a control or signaling device is guidable in an axial direction through the two recesses, and wherein the mounting plate is displaceable in the axial direction relative to the housing between a first end position and a second end position so as to provide a vertical compensation when the control or signaling device is fixed to the front plate, depending upon a thickness of the front plate.

2. The holding adapter according to claim 1, wherein the housing has a latching mechanism configured to interact with the mounting plate for vertical compensation.

3. The holding adapter according to claim 1, further comprising a spring element mounted in the housing and configured to interact with the mounting plate so that the mounting plate is displaceable from the first end position counter to a spring force of the spring element in the axial direction relative to the housing.

4. The holding adapter according to claim 1, wherein the housing has an anti-twist lug configured for a keyed interaction with the front plate, which is optionally removable.

5. The holding adapter according to claim 4, wherein the anti-twist lug is configured to be broken off or elastically bent against a spring force.

6. The holding adapter according to claim 4, wherein the anti-twist lug is formed as a separate part from the housing and is latched in a corresponding recess in the housing.

7. The holding adapter according to claim 1, wherein the housing has at least one holding pin configured to at least interact in a friction lock with the front plate.

8. The holding adapter according to claim 7, wherein a material hardness of the holding pin is greater than a material hardness of the front plate.

9. An arrangement, comprising:

a control or signaling device;

a front plate having an opening; and the holding adapter according to claim 1, wherein the control or signaling device is guidable from a front side of the front plate through the opening in the front plate and fastened by the holding adapter to a rear side of the front plate; and wherein the control or signaling device is configured to interact with the displaceable mounting plate of the holding adapter so as to produce a vertical compensation, depending upon a thickness of the front plate.

10. The arrangement according to claim 9, wherein the rear side of the front plate has a coating made of an elastic and/or foamed material in a region in which the front plate interacts with a holding pin of the housing at least frictionally.

* * * * *